US005572896A

United States Patent [19]

Story

[11] Patent Number: 5,572,896

[45] Date of Patent: Nov. 12, 1996

[54] STRAIN PATH CONTROL IN FORMING PROCESSES

[75] Inventor: James M. Story, Plum Boro, Pa.

[73] Assignee: Aluminum Company of America, Pittsburgh, Pa.

[21] Appl. No.: 201,894

[22] Filed: Feb. 25, 1994

[51] Int. Cl.[6] ..... B21D 22/00; B21D 22/21

[52] U.S. Cl. ..... 72/350; 72/351

[58] Field of Search ..... 72/347, 350, 351, 72/379.2

[56] References Cited

U.S. PATENT DOCUMENTS

| | | | |
|---|---|---|---|
| 1,970,134 | 8/1934 | Ferris | 72/358 |
| 2,294,676 | 9/1942 | McMillin et al. | 72/350 |
| 3,435,653 | 4/1967 | Scaletta et al. | 72/336 |
| 4,658,362 | 4/1987 | Bhatt | 72/60 |
| 4,704,887 | 11/1987 | Bachmann et al. | 72/347 |
| 4,711,611 | 12/1987 | Bachmann et al. | 72/336 |
| 4,962,654 | 10/1990 | Zbornik | 72/19 |
| 5,390,127 | 2/1995 | Tang et al. | 72/347 |

OTHER PUBLICATIONS

"Product Engeering", Oct. 16, 1961.

*Primary Examiner*—Lowell A. Larson
*Assistant Examiner*—Rodney Butler
*Attorney, Agent, or Firm*—Elroy Strickland

[57] ABSTRACT

A method of forming a metal sheet workpiece into a three-dimensional object by subjecting the workpiece to a stretch forming process along at least two strain paths having slopes of opposite sign. The strain paths define a point on a forming limit curve that is shifted substantially from a forming limit curve generated by linear strain paths. The shift in forming limit curves allows a substantially higher strain state to be reached in the workpiece in comparison to a strain state achievable using linear strain paths to attain the same strain state in flowing metal into a die cavity. The three-dimensional object is formed by flowing workpiece metal into a die cavity in a manner that controls the position and magnitude of forces restraining the periphery of the workpiece such that metal flow into the cavity takes place along the strain paths having the slopes of opposite sign.

11 Claims, 4 Drawing Sheets

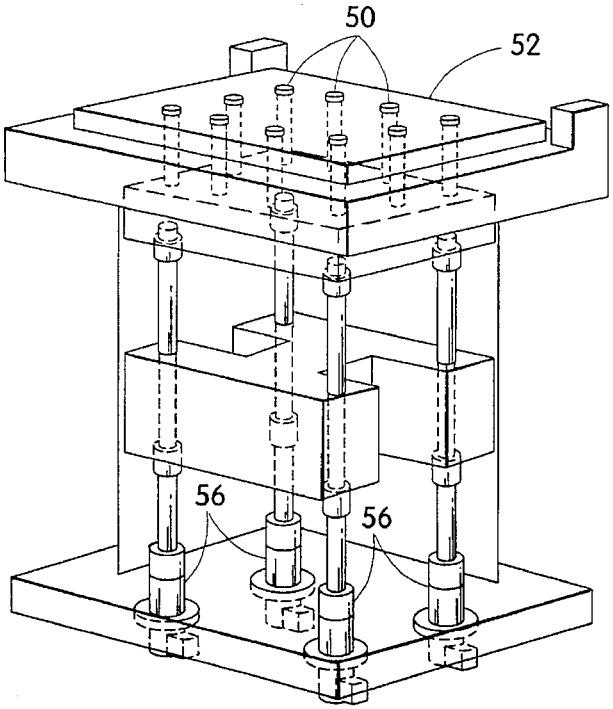
FIG. 9
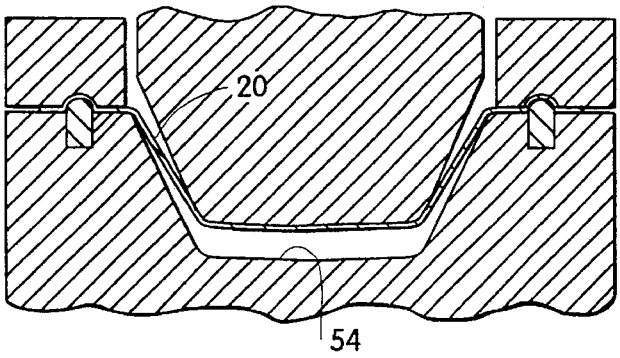
FIG. 10
FIG. 11
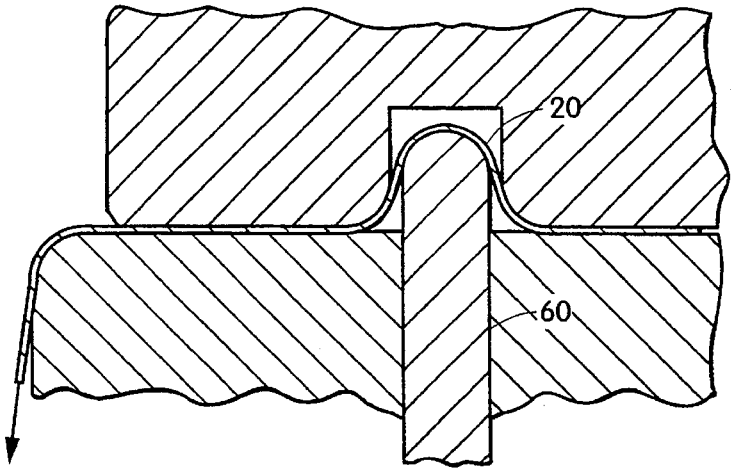

STRAIN PATH CONTROL IN FORMING PROCESSES

BACKGROUND OF THE INVENTION

The present invention relates generally to forming three-dimensional parts from a generally flat sheet or panel of metal, and particularly to a process in which the formability of the sheet or panel is substantially increased and controlled.

In conventional stretch or wrap forming, a sheet of metal is clamped by jaws, and a tool surface located between the jaws is moved into the sheet, with the jaws free to rotate to stretch the sheet over the tool surface. In stretch wrap forming, jaws are actuated such that the sheet can be stretched by displacement of the jaws either prior to or during motion of the center tool. A second set of jaws normal to the first set can be used to stretch the sheet in two directions over the center die surface.

The jaw motion during stretch wrap forming required to produce a desired part is generally determined by trial and error during a set-up of the stretchwrap apparatus to avoid wrinkling or tearing of the part while producing the desired shape after unloading. Material properties and initial thickness variability leads to variability in shape of the component produced (after spring-back) and to possible fracturing or wrinkling of the metal part. The motion of the double jaw sets located essentially normal to each other can be specified to result in strain paths which cause a forming limit curve or diagram to shift, resulting in improved formability along certain specific strain paths.

The study of formability received a substantial boost in the mid-1960's when the forming limit diagram was introduced, as discussed in the following list of papers:

S. P. Keeler, "Determination of Forming Limits in Automotive Stampings", *Sheet Metal Industries,* 42(461), 1965, pp. 683–691

S. P. Keeler, "Circular Grid System A Valuable Aid for Evaluating Sheet Metal Formability", SAE Paper No. 680092, 1968

G. M. Goodwin, "Application of Strain Analysis to Sheet Forming Problems in the Press Shop", SAE Paper No. 680093, 1968

K. Nakazima, T. Kikuma and K. Hisuka, *Yamata Technical Report No.* 264, 1972, p. 141

R. Pearce, *Sheet Metal Forming,* Adam Hilger, Bristol, 1991, pp. 143–175

S. Dinda, K. F. James, S. P. Keeler and P. Stine, *How to Use Grid Circle Analysis for Die Tryout,* ASM, 1981.

Figure 1:
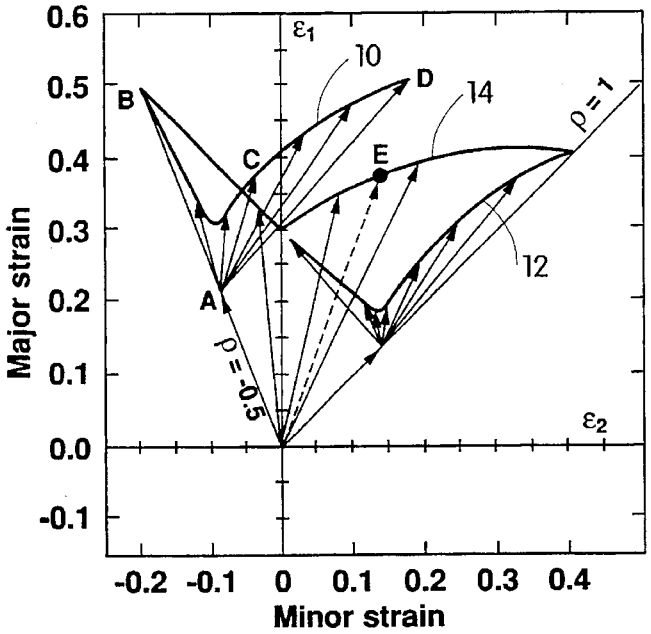
Figure 6:
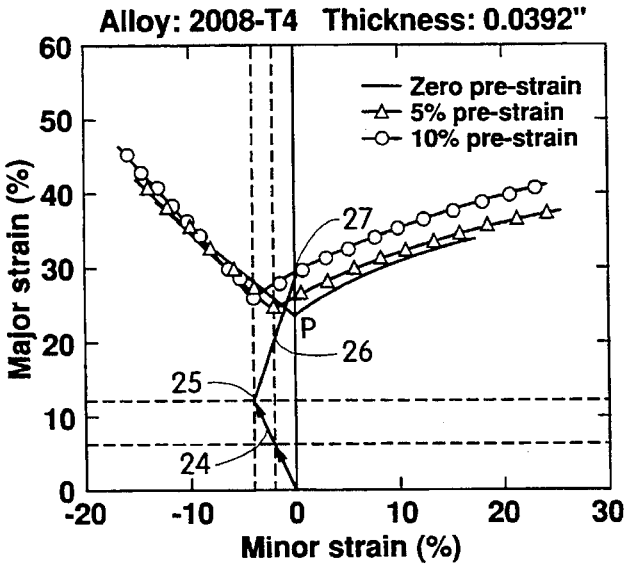

The forming limit diagram or curve is a map of the combinations of surface strains leading to success/failure in a sheet stamping operation. Forming limit diagrams are usually generated by stretching gridded samples of various widths over a hemisphere punch and into a die cavity under various conditions of friction. Major and minor strains are defined as the larger and smaller of the two in-plane principal strains, respectively. Circular grids are often used because they deform into ellipses, the major and minor axes of which can easily be used to calculate the principal strains. Wide samples with very good lubrication result in positive minor strains only slightly smaller than the major strains. Reducing sample width mid/or increasing friction results in smaller minor strains. There will be a sample width and friction condition which results in zero minor strain. Narrower samples yield negative minor strain. In FIGS. 1 and 6, major strain is the ordinate and minor strain is the abscissa.

SUMMARY OF THE INVENTION

It should be noted that forming limit diagrams are generated under proportional, linear loading conditions. It has been found that some materials, aluminum alloys in particular, when subjected to shifts in strain path, which can occur in complex stampings, exhibit substantial shifts in the forming limit curve. This yields improved formability when these particular strain paths are followed in the forming a three-dimensional component part.

The present invention is directed to forming a three-dimensional object or part from a generally planar sheet or panel of metal using strain paths for which the sign of the slope changes during the course of forming. Such strain paths establish strain limits beyond those attainable with a linear strain path. A higher maximum strain state in the part can be achieved, thus enabling deeper or more complex parts to be formed before the part fails by necking or tearing.

Control of strain paths, and thus control of the forming operation to attain such an improved strain state, can involve a number of apparatus controls, such as the manner in which blankholders grip the periphery of a workpiece (as it is being formed in the die cavity), by variable displacement cushion pins that bear against a blankholder during the forming process, by independently controllable drawbeads, or the use of segmented blankholders, such as shown in Applicant's U.S. Pat. No. 4,745,792 to Story et al.

In addition, strain paths leading to improved formability can be predetermined by use of experimental data, which are the results of experiments that follow different paths, as they are affected by varying restraining forces, as discussed hereinafter. In addition, strain paths can be predetermined by analytical models of material behavior, or forming process models, as described in the available literature, with material behavior incorporated therein. Five references on the subject of analytical models are:

D. D. Olander and A. K. Miller, "The Influence of Constitutive Behavior on Predicted Sheet Metal Forming Limits", *Controlling Sheet Metal Forming Processes,* Proc. 15th Biennial Congress IDDRG, 1988, pp. 133–144;

A. Barata Da Rocha and J. M. Jalinier, "Plastic Instability of Sheet Metals Under Simple and Complex Strain Paths", *Transactions of the Iron and Steel Institute of Japan,* 24, 1984, pp. 132–140;

F. Barlat, Barata Da Rocha and J. M. Jalinier, "Influence of Damage on the Plastic Instability of Sheet Metals Under Complex Strain Paths", *J. Materials Science,* 19, 1984, pp. 4133–4137;

A. Barata Da Rocha, F. Barlat and J. M. Jalinier, "Prediction of the Forming Limit Diagrams of Anisotropic Sheets in Linear and Nonlinear Loading", *Materials Science and Engineering,* 1984, pp. 151–164.

A. Graf and W. F. Hosford, "Effect of Changing Strain Paths on Forming Limit Diagrams of A1 2008-T4", *Metallurgical Transactions,* Vol. 24, No. 11 (November 1993), pp. 2503–2512.

In addition, the strain paths can be followed at critical locations when a component part is being formed, for example, by use of optical strain measuring techniques, such as described in Applicant's U.S. Pat. No. 4,811,582, and using such following and measuring to control jaw motions in at least two directions to assure that the desired strain paths are followed. Stamping can also be monitored and controlled analytically, or experimentally, relating something easily measured, such as the displacement vs. time of a free edge of a blank, to the desired strain path.

Strain distribution in the stretch-forming process is affected by such parameters as die geometry, friction, material properties, such as strain hardening, rate sensitivity, plastic anisotropy, and the restraining forces of jaw motions. Variability in these parameters can result in inconsistencies in the shape of the component produced, after springback, and variabilities in fracturing and wrinkling tendencies. The shift in the forming limit curve leaves more "margin for error" in failure while allowing higher in-plane forces, which helps in setting the shape of the component.

It is therefore an objective of the invention to control a forming process in a manner that appropriate strain paths are followed such that there is desensitization of the process to variations of the above input parameters.

THE DRAWINGS

Figure 2:
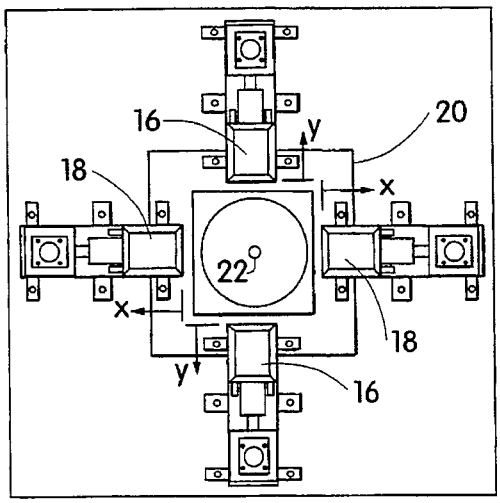
Figure 3:
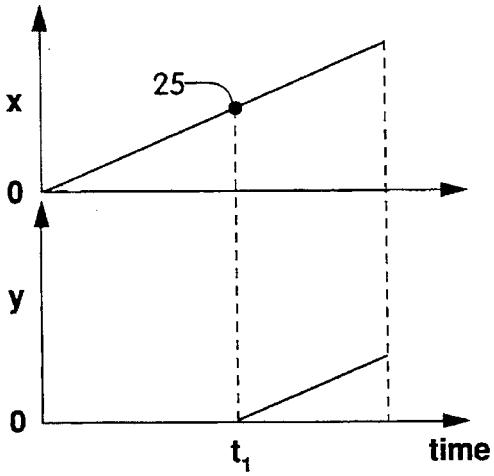
Figure 4:
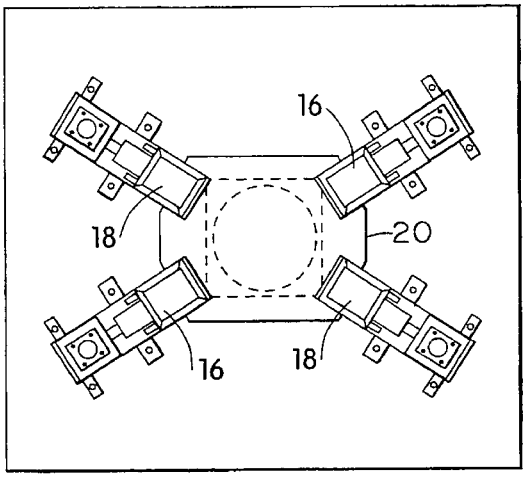
Figure 5:
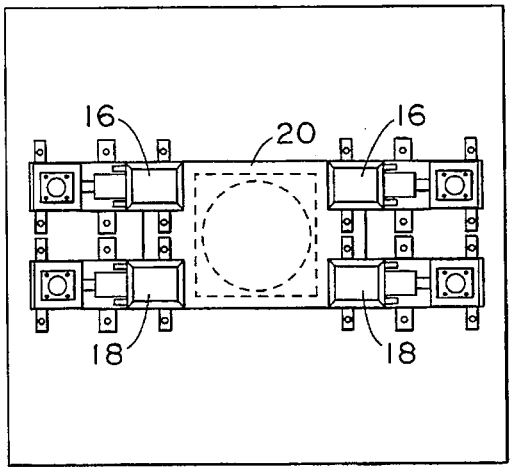
Figure 7:
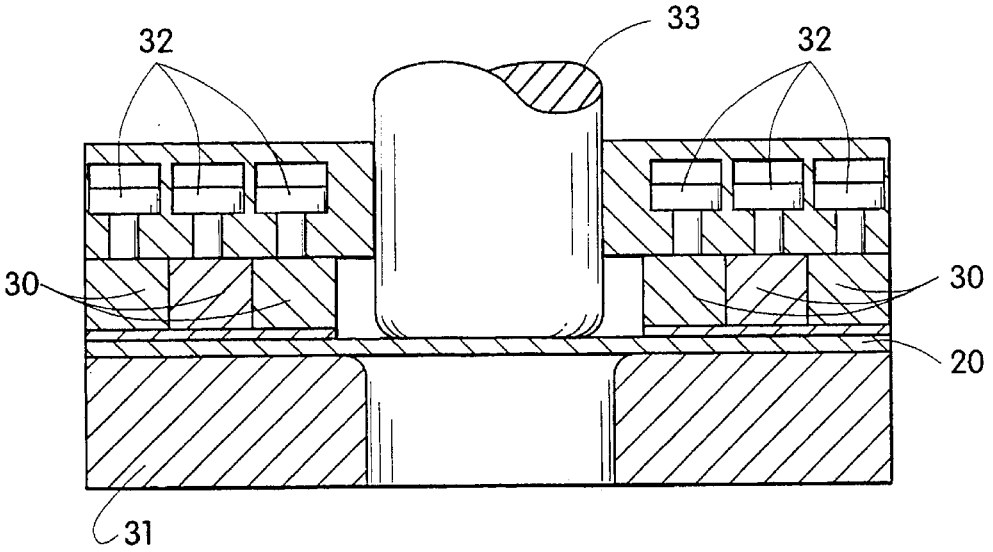
FIG. 7 (Prior Art)
Figure 8:
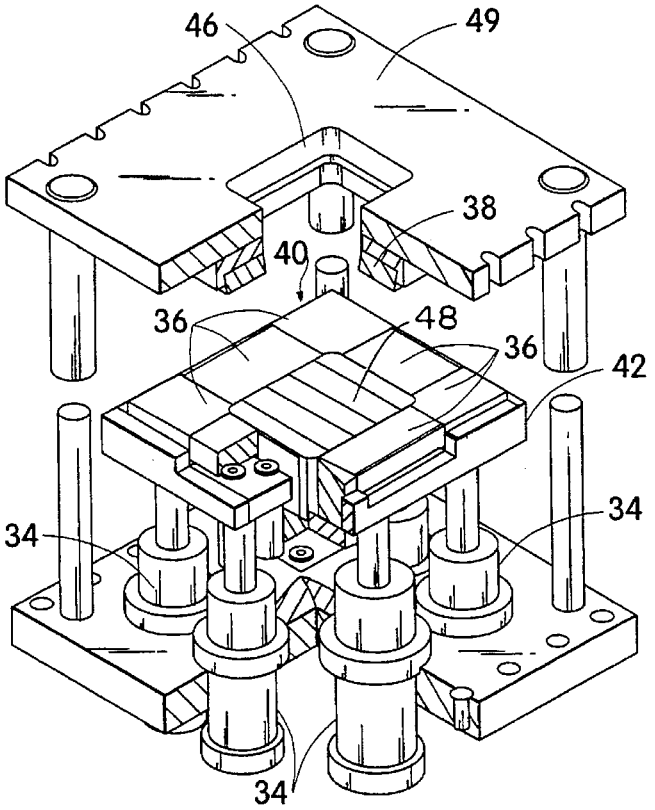

The objectives and advantages of the invention will be better understood from consideration of the following detailed description and the accompanying drawings in which:

FIG. 1 is a forming limit diagram or curve showing the effects of multiple strain paths on curve limits, FIG. 2 is a diagrammatic plan view of displacement jaws gripping the periphery of a panel or sheet member for stretching, FIG. 3 is a jaw displacement diagram for FIG. 2, FIGS. 4 and 5 show, respectively, two additional jaw set positions for stretching a workpiece in accordance with the principles of the present invention, FIG. 6 is a graph showing a series of strain paths in which the formability curve of a 2008-T4 aluminum alloy workpiece is substantially extended by using two strain paths that have slopes of opposite signs, FIG. 7 shows a sectional view of a prior segmented blankholder and a portion of a punch and draw die disclosed in the above Story et al patent, FIG. 8 shows in perspective a segmented blankholder or binder useful in employing the principles of the apparatus of the above Story et al patent, FIG. 9 is a perspective view of apparatus operable with a blankholder or binder, the apparatus having four comer cylinders and ten cushion pins extending through a bolster plate to affect the distribution of restraining forces with time and spatial position without the cushion pins, independent control of the four comer cylinders as a function of time can also affect strain path, FIG. 10 is a partial sectional view of apparatus that includes upper and lower binders with drawbeads, and FIG. 11 is a partial sectional view of binder apparatus having selectively movable drawbeads, only one of which is shown in the figure.

PREFERRED EMBODIMENTS

Referring now to the drawings, FIG. 1 thereof shows three forming limit curves 10, 12 and 14 plotted along lowest failure points that are the result of stretching a metal workpiece (not shown) along linear strain paths. The $\epsilon_1$ and $\epsilon_2$ coordinates of the graph are, respectively, the major and minor strains discussed earlier. Sheet metal workpieces are stretched along the linear paths for curve 14 until the metal of the workpiece fails. In FIG. 1, three failure points are shown at B, C and D which lie on a shifted forming limit curve 10. By moving in a direction different from the initial strain path, a shift takes place that allows the material of the workpiece to attain a forming state substantially beyond that attainable by following the initial (linear) path to point D. Point D can be attained, for example, by stretching in two strain paths OA and AD. If a linear path from point O to D is attempted, failure at point E would result.

Not all shifts in the forming limits depicted in FIG. 1 result in increased forming states. In viewing curve 12, for example, failure occurs at lower strains than the as-received curve 14 for all paths except balanced biaxial tension followed by balanced biaxial tension.

In further reference to FIG. 1, when $\epsilon_2$ (the minor strain) equals zero, the resulting major strain along the $\epsilon_1$ axis is known as the "plane strain" intercept.

FIG. 2 of the drawings shows schematically and in plan view jaw sets 16 and 18 gripping opposed edge portions of a generally planar workpiece 20 for stretching the same over a die surface (not shown). A grid 22 is provided on an exposed surface of the workpiece at or near the center of the workpiece. This grid can be viewed by optical sensing means (not shown) as the workpiece is stretched along chosen strain paths, as depicted in graph form in FIG. 6 of the drawings, for example, resulting from jaw displacements varying over time in the manner shown in FIG. 3. The optical sensing means views the configuration of grid 22, as it changes in the stretching process. The sensor of the optical means outputs a signal that can be used by operating personnel to indirectly control the process so that the strain paths are correctly followed, or the output of the sensor can be fed to control elements of the actual forming apparatus to effect direct control of the process. In either case, the optics are used to assure that the chosen strain paths are followed.

Continuing with the example of FIGS. 2, 3 and 6, a first set of the jaws in FIG. 2 (16 or 18) is moved while the other set remains stationary, and the first jaws can be moved independently of each other, as required. The movement of the first jaws in the x direction starts at zero time in FIG. 3 (see the upper portion of FIG. 3) as a function of time t along the abscissa in FIG. 3. The strain path resulting from the movement of the first jaw set is represented in FIG. 6 by curve 24 for initial stretching by the first jaw set. At point 25 in FIG. 6, stretching along this path is stopped. In FIG. 3 this occurs about midway of stretching time t of the first jaw set. The second jaw set is operated to begin stretching the workpiece in the y direction at time h in FIG. 3. (In FIG. 3, the x and y directions are on the ordinate of the graph depicted in the figure.) The second jaw set works in conjunction with the first to stretch the workpiece along path 26 in FIG. 6 toward a failure point 27, the sign of the slope of 26 being opposite that of curve 24. FIG. 6 of the drawings depicts the effect of uniaxial prestrain on the position of the forming limit curve for automotive sheet alloy 2008-T4. The figure shows that a bilinear strain path 24/26, the first step being about 12% uniaxial strain, as seen along the major strain axis of the graph in FIG. 6, can lead to a plane-strain intercept at point 27, 23% higher than a linear strain path OP to the same minor strain state at failure. A majority of stamping failures are said to occur near plane strain.

FIGS. 4 and 5 of the drawings show arrangements for gripping a workpiece 20 differently than in FIG. 2, enabling other shapes to be formed. FIG. 4 shows a diagonal arrangement for control of gripping jaws or blankholder segments while FIG. 5 shows parallel jaw arrangement for gripping only two sides of a rectangular workpiece 20. The arrangements in FIGS. 4 and 5, like that of FIG. 2, are schematic and can involve any number or arrangement of jaws or blankholder segments gripping the periphery of a workpiece.

Other means than independently operable jaws can be used to stretch a workpiece along predetermined strain paths to affect the advantageous shift in the forming limit curve. For example, FIG. 7 of the drawings shows segments 30 of a segmented blankholder and a lower die structure gripping the periphery of a workpiece 20. This figure is reproduced from the Applicant's earlier U.S. Pat. No. 4,745,792. Such a segmented blankholder employs respective cylinders to independently operate the segments in applying gripping forces to the workpiece. When a punch 33 forces the workpiece into the die, the cylinders can be individually controlled to commit the workpiece to be formed along predetermined strain paths to provide an increased formability state in the three-dimensional part formed from the workpiece.

Similarly, FIG. 8 of the drawings shows independently operable cylinders 34 employed to selectively move segments 36 of the lower binder or blankholder 40. In FIG. 8, eight cylinders are respectively connected to eight movable segments located in a frame 42 of the lower binder 40 for securing the edges of a workpiece (not shown in FIG. 8) between the lower and upper binder. By knowing in advance the locations of strain paths that provide a substantial increase in forming limits, cylinders 34 are operated under programmed conditions to translate segments 36 in a manner that selectively grip the edges of the workpiece against upper binder 38 per an experimentally or analytically predetermined pressure vs. time or displacement vs. time trajectory to result in the desired strain path. This allows selective flow of workpiece metal through opening 46, in the upper binder, as the upper binder descends on a center punch 48 in the lower binder to force workpiece metal over the punch as opening 46 descends to and around the metal and punch. Such tooling is used in a single action press. Thus, punch 48 is stationary while upper tool 49 moves down, and segments 36 move downward while applying a controlled pressure on the workpiece periphery to restrain metal flow. In a double action press, the punch and binder segments move in the same direction in two independent actions. Double action presses are discussed by Kergen and Jodogne in "Computerized Control of the Blankholder Pressure on Deep Drawing Processes", *Autobody Stamping Applications an Analysis,* SAE SP-897, 1992, pp. 51–56. Presses having additional actions can be used as long as they can accomplish similar tasks in localized regions of gripping a workpiece.

In a similar manner, cushion pins 50 extending through a bolster plate 52, as shown in FIG. 9, can be used to control the distribution of forces, with respect to pin location and/or time, by which a blankholder (not shown in FIG. 9) grips the periphery of a workpiece. With proper control by this method, metal can thereby be moved into a die cavity 54, such as shown in FIG. 10, along preselected strain paths, as a function of time.

In the case of FIG. 9, the total load applied by four cylinders 56 is selectively translated by ten cushion pins 50, though other combinations of cylinders and pins can be used.

FIGS. 10 and 11 of the drawings show yet another apparatus suitable for stretching a workpiece along preselected strain paths to achieve a shift in the forming curve and thus an increase in the level of forming. In FIG. 11, selectively movable, variable displacement, drawbeads 60 grip the periphery of a workpiece 20. Drawbead segments can be located along each border of a binder or blankholder and independently operated in a programmed manner to control metal flow into a die cavity along preselected strain paths.

Independently operable drawbeads per se are discussed in two papers entitled "New Concept for Hydraulically Controlled Sheet Metal Strip Drawing Test Apparatus", by Michler et al, as published in Volume XXI, 1993, of The Transactions of the NAMRI/SME, and "Drawbead Penetration as a Control Element of Material Flow", by J. Cao and Mary C. Boyce, Mar. 1–5, 1993, SAE Reprint from Sheet Metal and Stamping Symposium (SP-944), pp. 145–153.

While the invention has been described in terms of preferred embodiments, the claims appended hereto are intended to encompass all embodiments which fall within the spirit of the invention.

What is claimed is:

1. A method of forming a generally planar sheet metal workpiece into a three-dimensional object by subjecting the workpiece to a stretch forming process employing at least two strain paths that have slopes of opposite sign, said strain paths defining a point on a forming limit curve that is shifted substantially from a forming limit curve generated by linear strain paths, the method comprising:

choosing at least two strain paths that have slopes of opposite sign for stretching the workpiece in a manner that will shift substantially the position of the forming limit curve from that of a forming limit curve generated by stretching the workpiece along linear strain paths, said shift allowing a substantially higher strain state to be reached in the workpiece in comparison to a strain state achievable using linear strain paths to attain the same strain state in flowing workpiece metal into a die cavity under forces that restrain the periphery of the workpiece, and forming the three-dimensional object from the sheet metal workpiece by flowing workpiece metal into a die cavity in a manner that selectively controls the position and magnitude of forces restraining the periphery of the workpiece such that the metal flow into the die cavity takes place selectively along the strain paths having the slopes of opposite sign.

2. The method of claim 1 in which the sheet metal workpiece is stretched along said strain paths using stamping tools that include a blankholder, a die and a punch, and controlling said blankholder in a manner that controls straining of the workpiece along said strain paths by the punch forcing material into a cavity of said die.

3. The method of claim 2 including using variable displacement cushion pins located to bear against the die, and varying respective loads on the pins as a function of time to selectively control the flow of metal into the die cavity along said strain paths.

4. The method of claim 2 including controlling blankholder load with the use of variable displacement cushion pins and/or independently operable cylinders.

5. The method of claim 2 including using independently controllable segments of a segmented blankholder, in combination with the die and punch, to selectively restrain the flow of sheet metal along said strain paths into the die cavity in stretching the workpiece.

6. The method of claim 2 including using independently controllable, variable displacement drawbeads in the blankholder, in combination with the die and punch, to selectively restrain the flow of sheet metal along said strain paths into the die cavity in deforming the workpiece.

7. A method of forming a generally planar sheet metal workpiece into a three-dimensional object by subjecting the workpiece to a stretch forming process employing at least two strain paths that have slopes of opposite sign, said strain paths defining a point on a forming limit curve that is shifted substantially from a forming limit curve generated by linear strain paths, the method comprising:

using models of material behavior to define said strain paths, said paths causing a shift in the position of the forming limit curve to obtain an improved strain state in the workpiece, and deforming said workpiece along the strain paths having the slopes of opposite sign using said models of material behavior, the deforming step providing a three-dimensional object.

8. A method of forming a generally planar sheet metal workpiece into a three-dimensional object by subjecting the workpiece to a stretch forming process employing at least two strain paths that have slopes of opposite sign, said strain paths defining a point on a forming limit curve that is shifted substantially from a forming limit curve generated by linear strain paths, the method comprising:

using forming process models with material behavior incorporated therein to define as a function of time cylinder loads that selectively restrain the flow of workpiece material into a die cavity along said strain paths, and forming said workpiece into a three-dimensional object in said die cavity using the forming process models.

9. A method of forming a generally planar sheet metal workpiece into a three-dimensional object by subjecting the workpiece to a stretch forming process employing at least two strain paths that have slopes of opposite sign, said strain paths defining a point on a forming limit curve that is shifted substantially from a forming limit curve generated by linear strain paths, the method comprising:

using forming process models with material behavior incorporated therein to define as a function of time variable displacement cushion pins located to bear against a die and binderload to selectively restrain the flow of sheet metal into a cavity of the die along said strain paths, and forming said workpiece into a three-dimensional object in said die cavity using the forming process models.

10. A method of forming a generally planar sheet metal workpiece into a three-dimensional object by subjecting the workpiece to a stretch forming process employing at least two strain paths that have slopes of opposite sign, said strain paths defining a point on a forming limit curve that is shifted substantially from a forming limit curve generated by linear strain paths, the method comprising:

using forming process models with material behavior incorporated therein to define as a function of time variable drawbead displacements to selectively restrain the flow of sheet metal into a cavity of the die along said strain paths, and forming said workpiece into a three-dimensional object in said die cavity using the forming process models.

11. A method of forming a generally planar sheet metal workpiece into a three-dimensional object by subjecting the workpiece to a stretch forming process employing at least two strain paths that have slopes of opposite sign, said strain paths defining a point on a forming limit curve that is shifted substantially from a forming limit curve generated by linear strain paths, the method comprising:

using forming process models with material behavior incorporated therein to define as a function of time the displacement of jaws gripping the workpiece to stretch the same along said strain paths, and forming said workpiece into a three-dimensional object in a die cavity using the forming process models.

* * * * *